US006036544A

United States Patent [19]

Brunker et al.

[11] Patent Number: 6,036,544

[45] Date of Patent: Mar. 14, 2000

[54] COUPLED ELECTRICAL CONNECTOR ASSEMBLY

[75] Inventors: David L. Brunker, Naperville; Maxwill P. Bassler, Hampshire, both of Ill.

[73] Assignee: Molex Incorporated, Lisle, Ill.

[21] Appl. No.: 09/008,381

[22] Filed: Jan. 16, 1998

[51] Int. Cl.[7] ..... H01R 13/648

[52] U.S. Cl. ..... 439/607; 439/609; 439/620

[58] Field of Search ..... 439/620, 607, 439/609, 541.5

[56] References Cited

U.S. PATENT DOCUMENTS

| | | | |
|---|---|---|---|
| 4,659,163 | 4/1987 | Althouse et al. | 339/143 |
| 4,797,120 | 1/1989 | Ulery | 439/578 |
| 4,884,982 | 12/1989 | Fleming et al. | 439/620 |
| 4,934,960 | 6/1990 | Capp et al. | 439/620 |
| 5,032,091 | 7/1991 | Itzkoff | 439/620 |
| 5,062,811 | 11/1991 | Hackman | 439/620 |
| 5,108,300 | 4/1992 | Weber | 439/188 |
| 5,145,412 | 9/1992 | Tan et al. | 439/620 |
| 5,167,536 | 12/1992 | Wang | 439/620 |
| 5,192,230 | 3/1993 | Gabany et al. | 439/620 |
| 5,221,216 | 6/1993 | Gabany et al. | 439/620 |
| 5,326,280 | 7/1994 | Briones et al. | 439/581 |
| 5,340,325 | 8/1994 | Pai | 439/188 |
| 5,397,250 | 3/1995 | Briones | 439/620 |
| 5,401,192 | 3/1995 | Briones et al. | 439/639 |
| 5,407,366 | 4/1995 | Briones et al. | 439/639 |
| 5,601,451 | 2/1997 | Driones et al. | 439/490 |
| 5,637,015 | 6/1997 | Tan et al. | 439/607 |
| 5,755,595 | 5/1998 | Davis et al. | 439/607 |

*Primary Examiner*—Paula Bradley
*Assistant Examiner*—Katrina Davis
*Attorney, Agent, or Firm*—James C. Paschall

[57] ABSTRACT

An electrical connector assembly includes an electrical connector mounting a plurality of terminals and including an outer conductive shell. A dielectric insert defines a receptacle for the electrical connector. An outer shielding shell surrounds a substantial portion of the dielectric insert. A electrical element is captured by the dielectric insert and is held in contact between the outer conductive shell of the connector and the outer shielding shell to establish an electrical coupling therebetween.

27 Claims, 9 Drawing Sheets

COUPLED ELECTRICAL CONNECTOR ASSEMBLY

FIELD OF THE INVENTION

This invention generally relates to the art of electrical connectors and, particularly, to an electrical connector assembly which includes an electrical network having at least one electrical element such as a capacitor, resistor or the like.

BACKGROUND OF THE INVENTION

Electrical circuitry often must be protected from electromagnetic interference (EMI) and radio frequency interference (RFI) entering or exiting the system. Users of the system also must be protected from dangerous voltage differentials. In other words, many electrical systems are required to be both "quiet and safe".

In various electrical circuitry, electrical connector assemblies may be mounted for connecting the circuitry through a panel or to a printed circuit board or both. In some instances, the panel is conductive and may comprise the frame or chassis of the apparatus, such as a personal computer. Whether an electrical connector used in such systems is mounted to a panel, to a circuit board or both, the connector may include a capacitive coupling which functions to direct high frequency voltages from the connector to the panel or to the board while isolating the connector from direct contact to the panel or to the board. In essence, selective coupling is provided between the connector and ground.

The present invention is directed to improvements in such electrical networks which include isolating an electrical connector. The network includes electrical elements which can effectively protect the circuitry and equipment as well as the user from high frequency interference and substantial voltage differentials.

SUMMARY OF THE INVENTION

An object, therefore, of the invention is to provide a new and improved electrical connector assembly for use in systems as described above.

In the exemplary embodiment of the invention, the assembly includes a dielectric housing defining first and second connector portions. The first connector portion mounts at least one electrical terminal adapted for engaging an appropriate terminal of a first complementary mating connector. The second connector portion defines a receptacle. An electrical connector includes an outer conductive shell mounted in the receptacle and has at least one electrical terminal adapted for engaging an appropriate terminal of a second complementary mating connector. A conductive shielding shell is disposed about a substantial portion of the dielectric housing. An electrical element is captured by the second connector portion of the dielectric housing and is held in contact between the outer conductive shell of the electrical connector and the conductive shielding shell to establish a electrical coupling therebetween.

The electrical element may be a capacitor, a resistor, an inductor, a diode or another suitable electrical element. The outer conductive shell of the connector and the outer shielding shell may be stamped and formed of sheet metal material and include spring fingers for engaging opposite electrodes of the electrical element. A compliant conductive interposer may be inserted between the electrodes of the electrical elements and the spring fingers to cushion and ensure good electrical contact. The conductive shielding shell may include one or more contacts, such as cantilevered spring arms, for engaging an appropriate outer conductive shell of the first complementary mating connector to establish a direct electrical coupling between the shielding shell and the mating connector.

A feature of the invention is that the second connector portion of the dielectric housing means is a dielectric insert separate from the first connector portion of the dielectric housing. The dielectric insert includes a pocket for receiving the electrical element. The dielectric insert includes a movable wall for opening the pocket to allow for insertion of the electrical element therein to and for closing the pocket to capture the electrical element therein. As disclosed herein, the dielectric insert includes at least a pair of relatively movable side walls defining the receptacle and forming the movable wall, with one of the side walls including the pocket for the electrical element, and the other side wall being adapted for opening and closing the pocket. Still further, the dielectric insert, including the side walls thereof, is molded of plastic material, and the side walls are joined for relative movement by an integrally molded hinge means.

Finally, the outer shielding shell of the assembly may include legs for mounting the assembly on a printed circuit board and connecting the shell to a ground trace on the board. As disclosed herein, the outer conductive shell of the connector may also include leg portions for mounting the assembly on the printed circuit board. The conductive shell of the electrical connector may protrude in front of the dielectric housing and provide latching flanges for interengagement with a latch of the second complementary mating connector.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
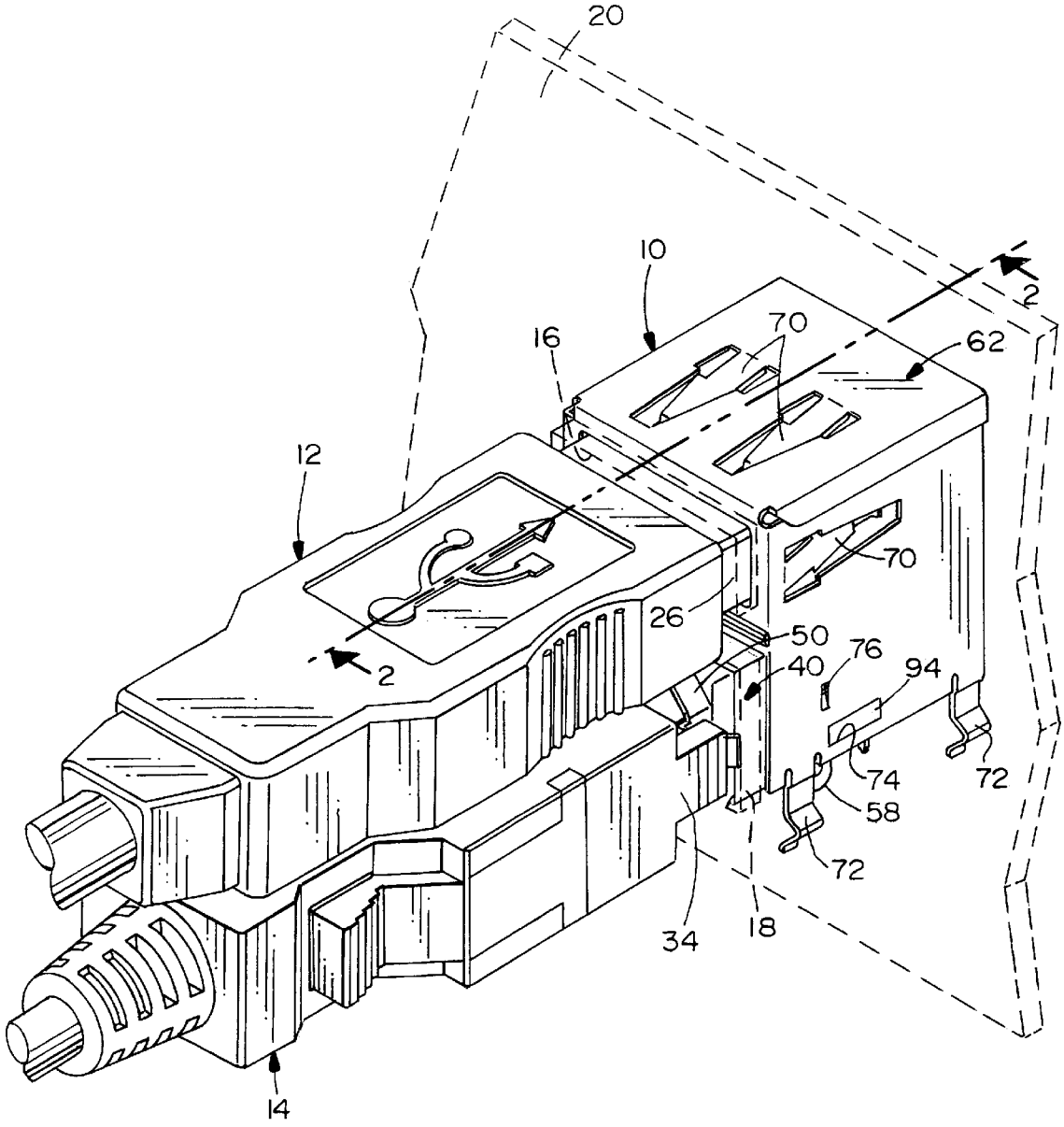
FIG. 1 is a perspective view of an electrical connector assembly incorporating the concepts of the invention, with the assembly mounted through a panel (in phantom) and mated with a pair of complementary mating connectors.

Referring to the drawings in greater detail, and first to FIG. 1, the invention is embodied in an electrical connector assembly, generally designated 10, which is adapted for mating with first and second complementary mating connectors, generally designed 12 and 14, respectively. The connector assembly is shown mated with connectors 12 and 14 through apertures 16 and 18 in a panel shown in phantom. The panel may be part of a conductive frame or chassis of a computer, for instance. Connector assembly 10 also is adapted for mounting on a printed circuit board, as will be seen hereinafter.

Figure 2:
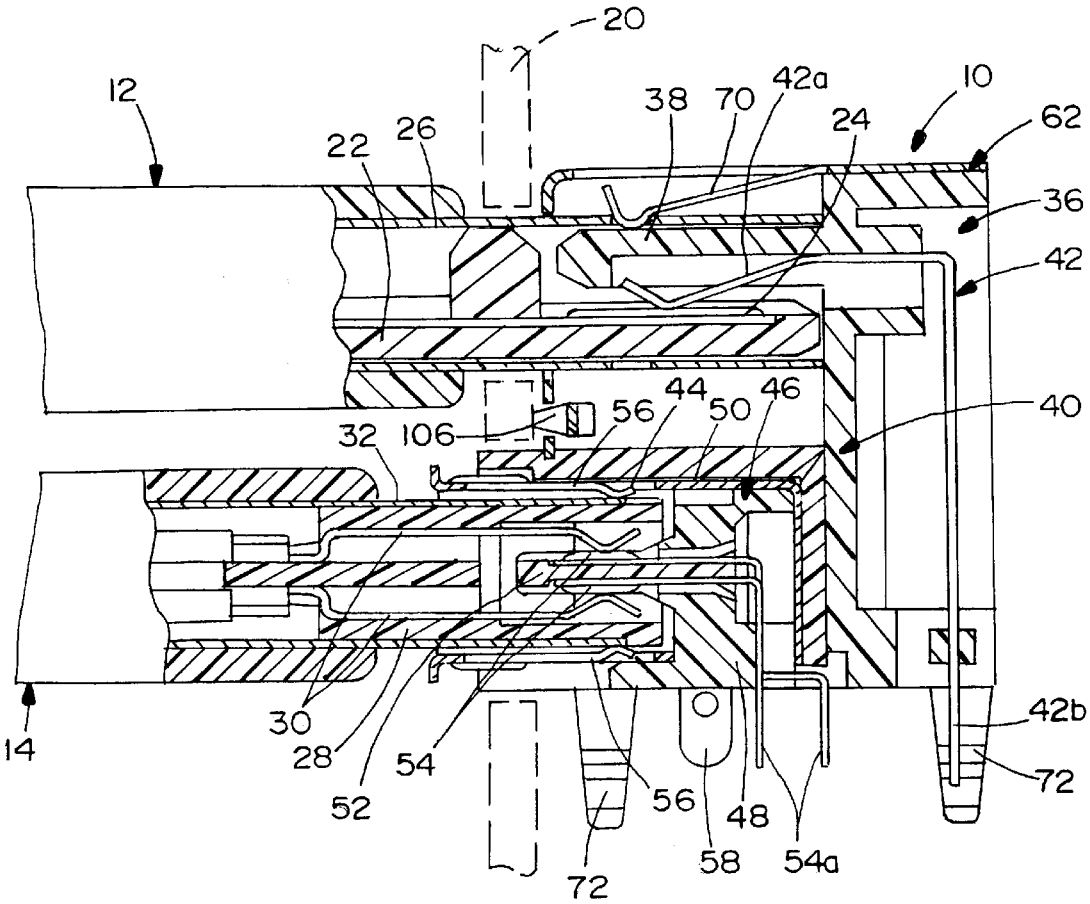
FIG. 2 is a vertical section taken generally along line 2—2 of FIG. 1.

Referring to FIG. 2 in conjunction with FIG. 1, first or upper mating connector 12 includes a forwardly projecting dielectric mating portion 22 having one or more leaf-type terminals 24 thereon. At least the mating portion is substantially surrounded by an outer conductive shell 26, such as a shell stamped and formed of sheet metal material.

Second or lower mating connector 14 also has a forwardly projecting dielectric mating portion 28 which defines a housing surrounding a plurality of spring type terminals 30. An outer conductive shell 32 surrounds forwardly projecting mating portion 28. The shell may be fabricated of conductive sheet metal material. A pair of latch arms 34 project forwardly of lower connector 14 on the outside of mating portion 28 and shell 32.

Electrical connector assembly 10 includes a dielectric housing, generally designated 36 (FIG. 2), which includes a first or upper connector portion 38 and a second or lower connector portion, generally designated 40. The housing 36 mounts one or more terminals, generally designated 42. Each terminal is generally L-shaped and includes a spring type leg or contact portion 42*a* and a depending leg or tail portion 42*b*. Contact portion 42*a* is disposed on upper connector portion 38 for engaging a respective one of the terminals 24 of upper mating connector 12. Tail portion 42*b* projects below the housing means for insertion into a hole in a printed circuit board and for soldering to a circuit trace on the board and/or in the hole. Although it is not shown, the tail portions may alternatively be configured to be surface mounted to appropriate signal traces on the board.

Figure 3:
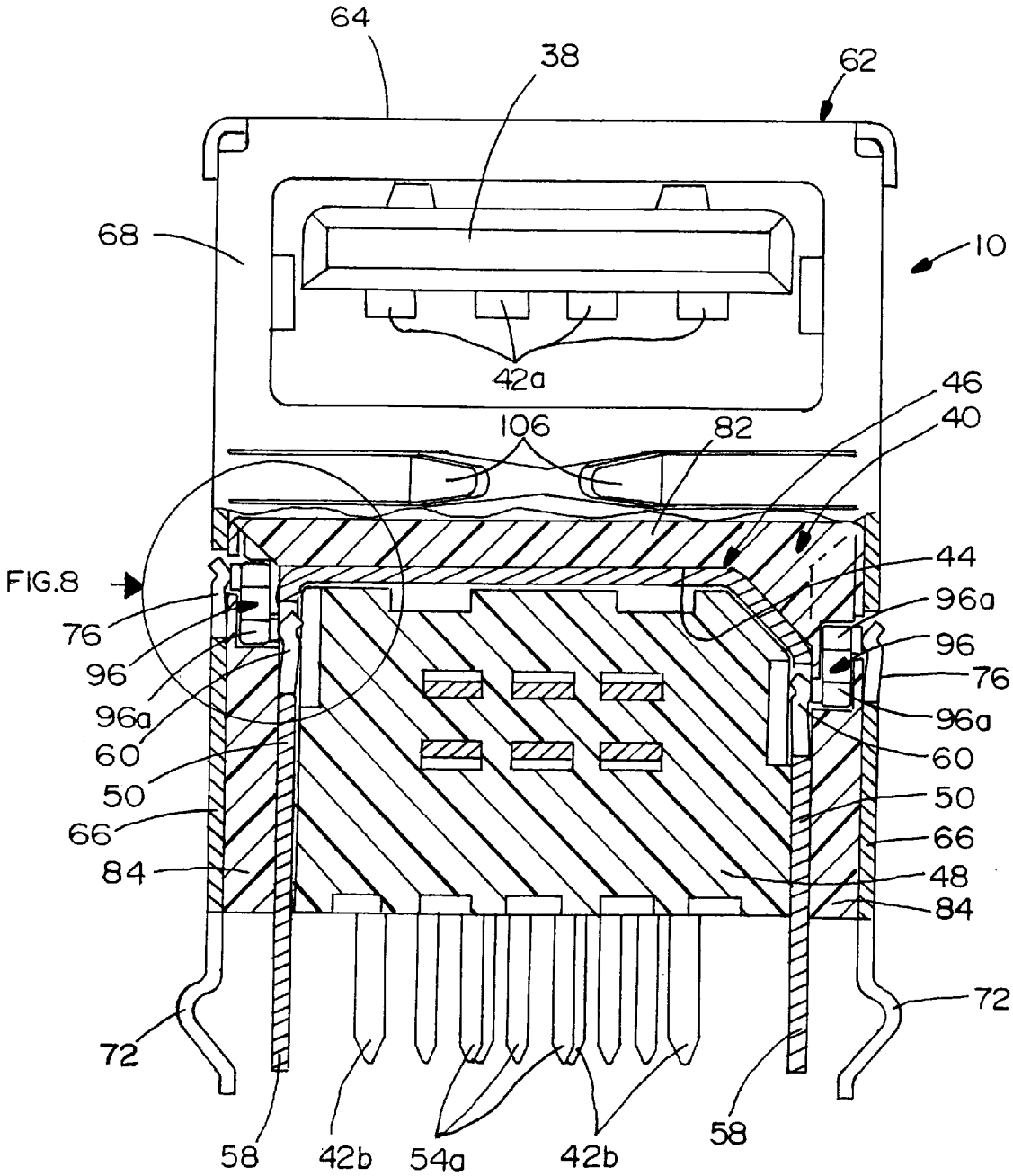
FIG. 3 is a fragmented vertical section taken along line 3—3 of FIG. 9.
Figure 7:
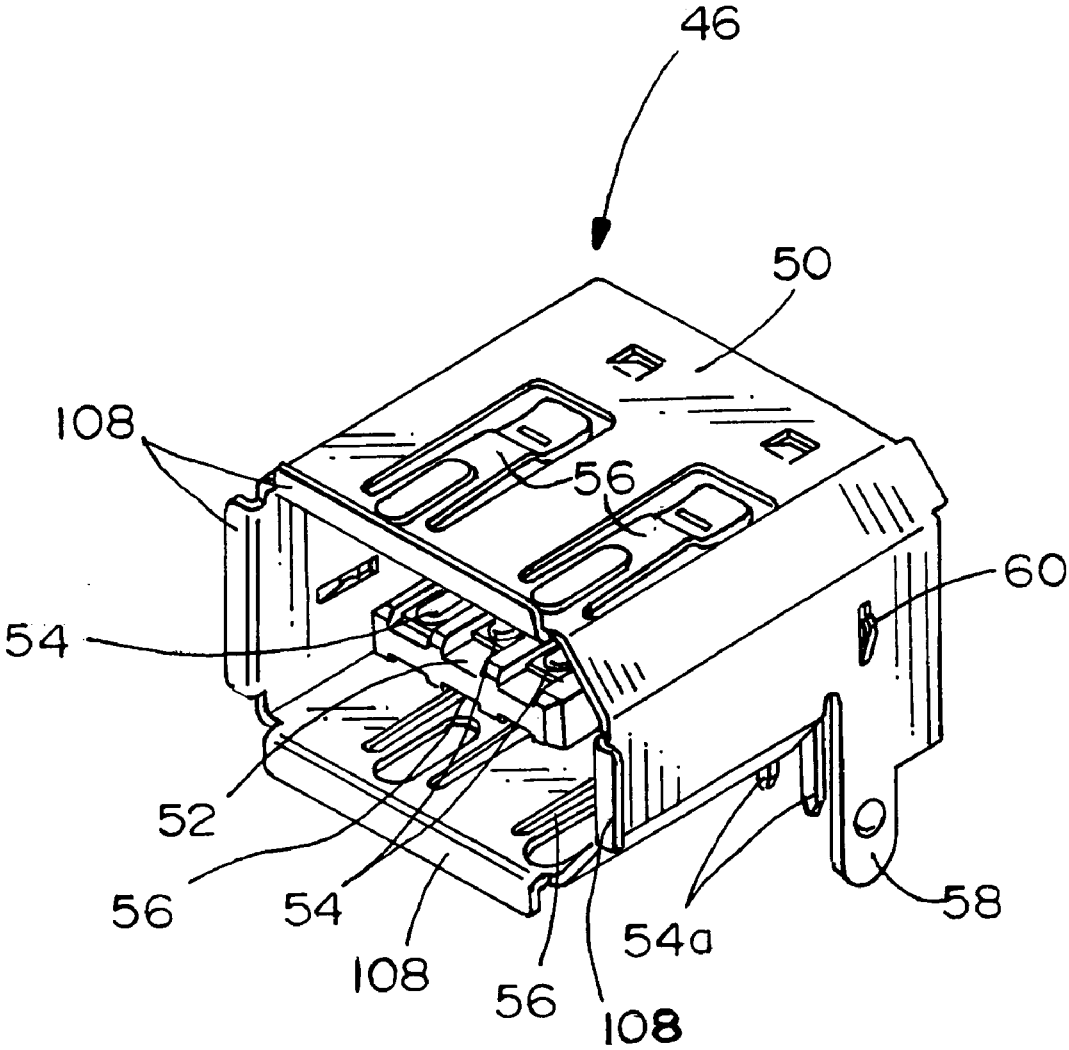
FIG. 7 is a perspective view of the electrical connector to be mounted within the dielectric insert.

Referring to FIG. 3 in conjunction with FIG. 2, the second or lower connector portion 40 of dielectric housing means 36 defines a receptacle 44 for receiving an electrical connector, generally designated 46. The electrical connector is shown isolated in FIG. 7 and includes an interior dielectric housing 48 (FIG. 2) substantially surrounded by an outer conductive shell 50 as best seen in FIG. 7. Dielectric housing 48 includes a forwardly projecting mating portion or tongue 52 having leaf-type terminals 54 on opposite sides thereof for engaging spring-type terminals 30 of lower mating connector 14. Terminals 54 have depending tail portions 54*a* for solder connection to appropriate signal traces on the board by insertion into holes in the printed circuit board. Although it is not shown, the tail portions may alternatively be configured to be surface mounted to appropriate signal traces on the board. Outer conductive shell 50 of connector 46 has a pair of spring fingers 56 on the top and bottom thereof for engaging outer shell 32 of lower mating connector 14. Therefore, the outer shells of connectors 14 and 46 are electrically commoned. Shell 50 also may have a pair of depending leg portions 58 for insertion into appropriate holes in the printed circuit board and for connection to grounding traces on the board. However, these legs may be eliminated in certain applications. Finally, outer shell 50 of connector 46 has outwardly projecting spring fingers 60 on opposite sides thereof as best seen in FIGS. 3 and 7. The entire outer shell 50 can be stamped and formed of sheet metal material.

Figure 4:
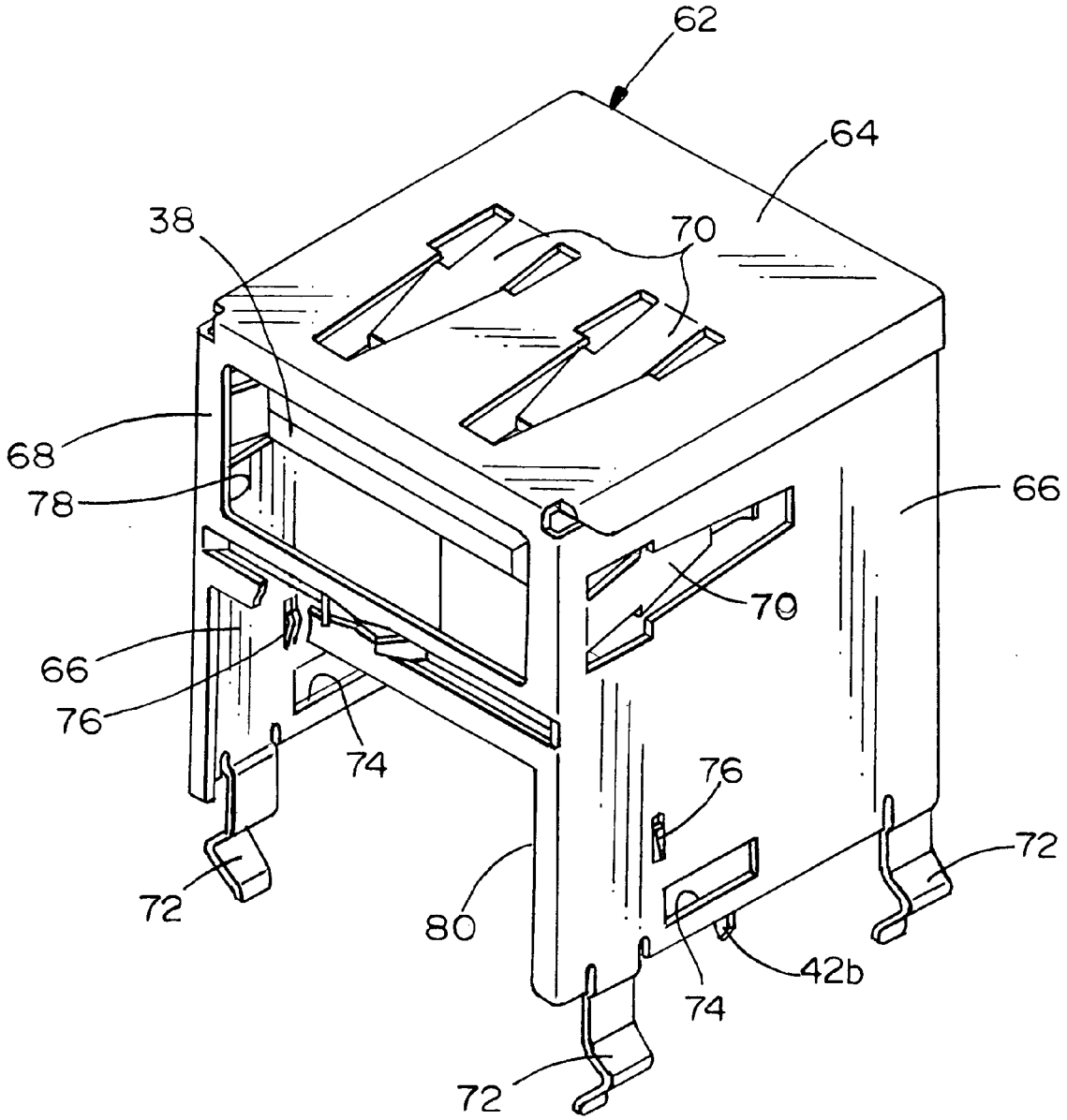
FIG. 4 is a perspective view of the outer conductive shielding shell of the connector assembly.

FIG. 4 best shows the configuration of an overall, outer conductive shielding shell, generally designated 62, which substantially surrounds dielectric housing 36, including dielectric insert 40, of connector assembly 10. The shielding shell can be stamped and formed of sheet metal material to include a top wall 64, opposite side walls 66 and a front wall 68. A plurality of spring fingers 70 are stamped and formed from top wall 64 and side walls 66 for engaging the shield 26 of the upper complementary mating connector 12. A pair of legs 72 depend from each side wall 66 of the shell for insertion into appropriate holes in the printed circuit board and for connection to appropriate ground traces on the board and/or in the holes. Each side wall 66 of the shell has an aperture 74, for purposes described hereinafter, as well as an inwardly directed spring finger 76. Front wall 68 of the shell has a top opening 78 through which upper mating connector 12 is inserted, as well as a bottom opening 80 through which the front mating end of electrical connector 46 projects as best seen in FIG. 2.

Figure 5:
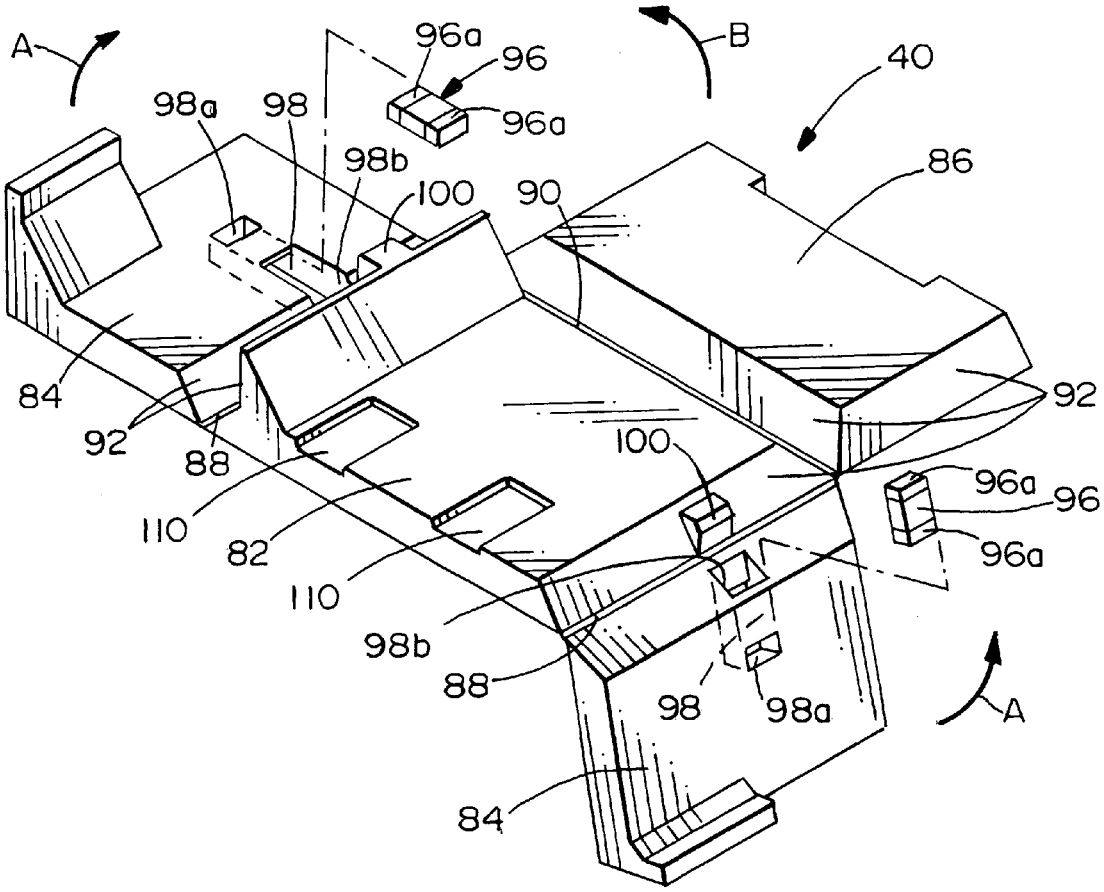
FIG. 5 is a perspective view of the dielectric insert in open condition.
Figure 6:
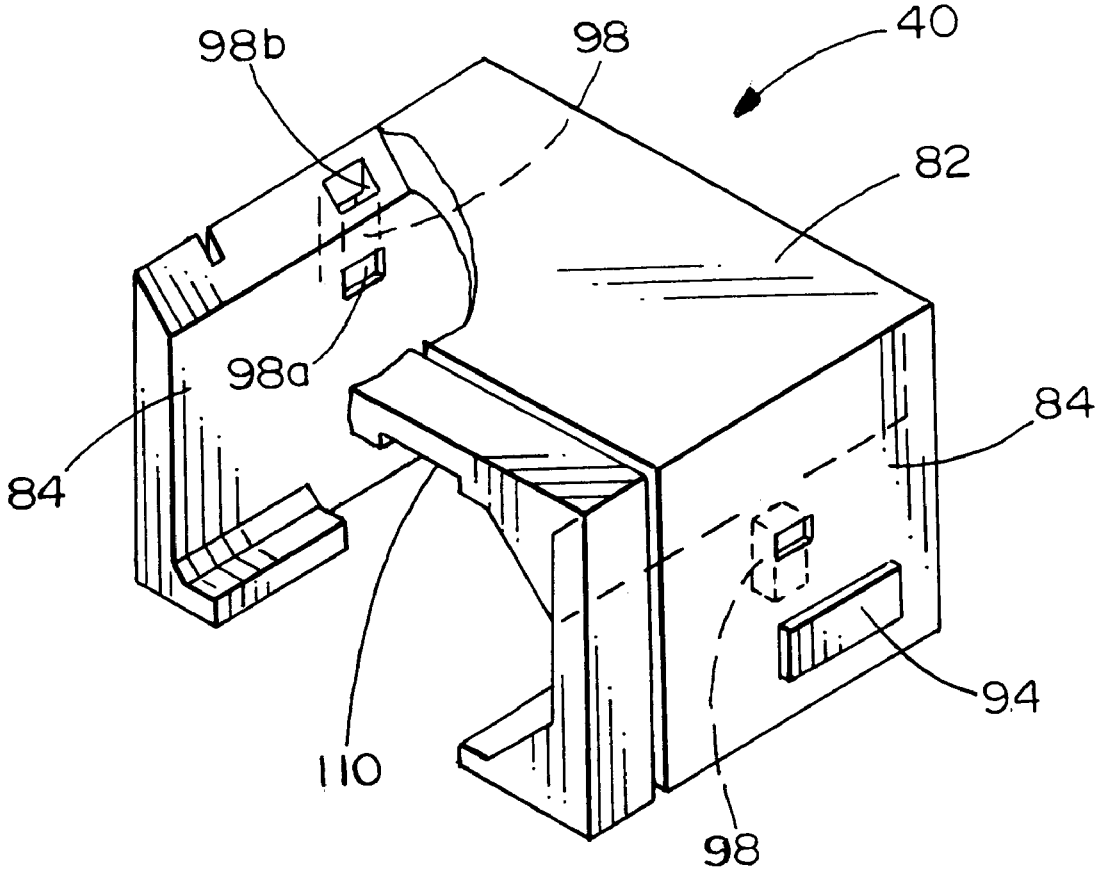
FIG. 6 is a perspective view of the dielectric insert in closed condition.

FIGS. 5 and 6 show second or lower connector portion 40 of the dielectric housing 36 (FIG. 2) to be a foldable structure which forms a separate dielectric insert for assembly within electrical connector assembly 10. However, it should be understood that the second or lower connector portion can be integral with the first or upper connector portion 38 to form a one-piece dielectric housing 36. Dielectric insert 40 is a one-piece structure including a top wall 82, a pair of side walls 84 and a rear wall 86. Side walls 84 are joined to top wall 82 by integrally molded living hinges 88. Rear wall 86 is joined to top wall 82 by an integrally molded living hinge 90. FIG. 5 shows the insert in open condition, and FIG. 6 shows the insert in its closed condition, with top wall 82 facing upwardly as shown in FIGS. 2 and 3. The insert is closed by folding side walls 84 relative to top wall 82 in the direction of arrows "A" (FIG. 5), and folding rear wall 86 relative to the top wall in the direction of arrow "B" until the walls form a box-like enclosure as shown in FIG. 6. The adjacent edges 92 of the walls are chamfered to facilitate completely closing of the structure. As seen in FIG. 6, each side wall 84 has an outwardly projecting rectangular boss 94 for snapping into openings 74 (FIG. 4) in side walls 66 of shielding shell 62 to facilitate mounting the insert within the shell.

Dielectric insert 40 (FIGS. 5 and 6) provides a means for mounting one or more electrical elements, generally designated 96, to facilitate establishing an electrical coupling between outer shell 50 of connector 46 and outer shielding shell 62 of the assembly. More particularly, each side wall 84 of the insert includes a pocket 98 having a closed end 98*a* and an open end 98*b*. When the insert is in its open condition as shown in FIG. 5, electrical elements 96 can be positioned in pockets 98 through open ends 98*b* thereof until the elements abut against closed ends 98*a* of the pockets. When the dielectric insert is folded to its closed position as shown in FIG. 6, a pair of bosses 100 at opposite edges of top wall 82 move into open ends 98*b* of the pockets to completely close the pockets and capture elements 96 therewithin.

Figure 8:
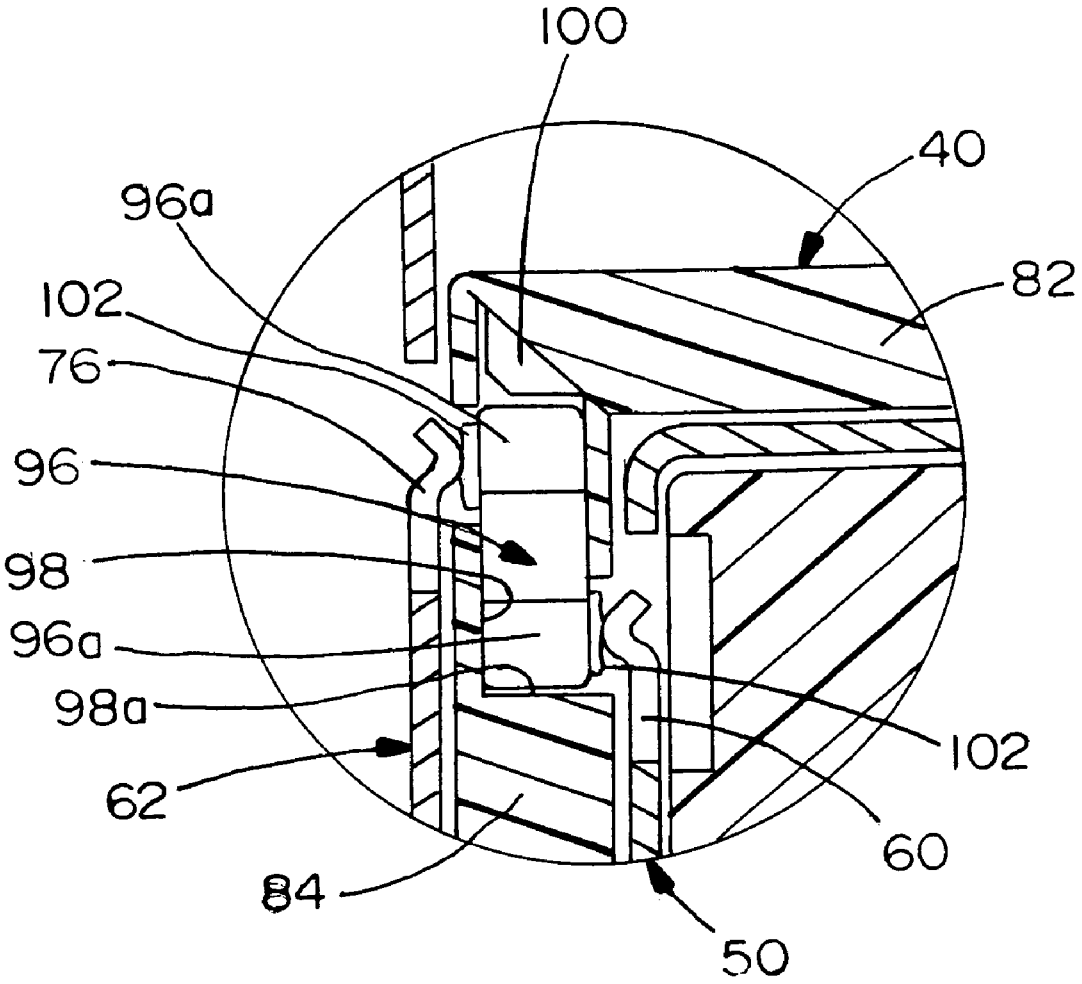
FIG. 8 an enlargement of the area of contact between the outer shielding shell and the shell of the connector with the electrical element encircled in FIG. 3.

FIG. 8 shows dielectric insert 40 in its closed position capturing one of the elements 96 within its respective pocket 98. The electrical element may be a capacitor, a resistor, an inductor, a diode or other suitable element. In either event, the element includes opposite electrodes 96*a* which are shown in FIG. 8 to be engageable with one of the spring fingers 60 of outer shell 50 of electrical connector 46, and the other electrode is in contact with one of the spring fingers 76 of outer shielding shell 62. This contact area with the electrical element is shown in FIG. 3 at both opposite sides of the connector assembly. Therefore, the electrical elements establish a predetermined electrical coupling between the outer shell 50 of connector 46 and the outer shielding shell 62 of the connector assembly. In the case of the electrical element being a capacitor element, a capacitive electrical coupling will be established between the two shells. It is contemplated that one electrical element or a plurality of electrical elements comprising a network can be coupled between the shell 50 of the connector 46 and the outer shielding shell 62 of the connector assembly. In such a network the electrical components can all be the same or different components.

FIG. 8 shows that a pair of compliant conductive pads 102 can be disposed between electrodes 96*a* of electrical element 96 and spring fingers 60 and 76 of the two conductive shells. These compliant conductive pads may be fabricated of a conductive fibrous material to absorb any tolerances created during manufacture of the assembly.

Figure 9:
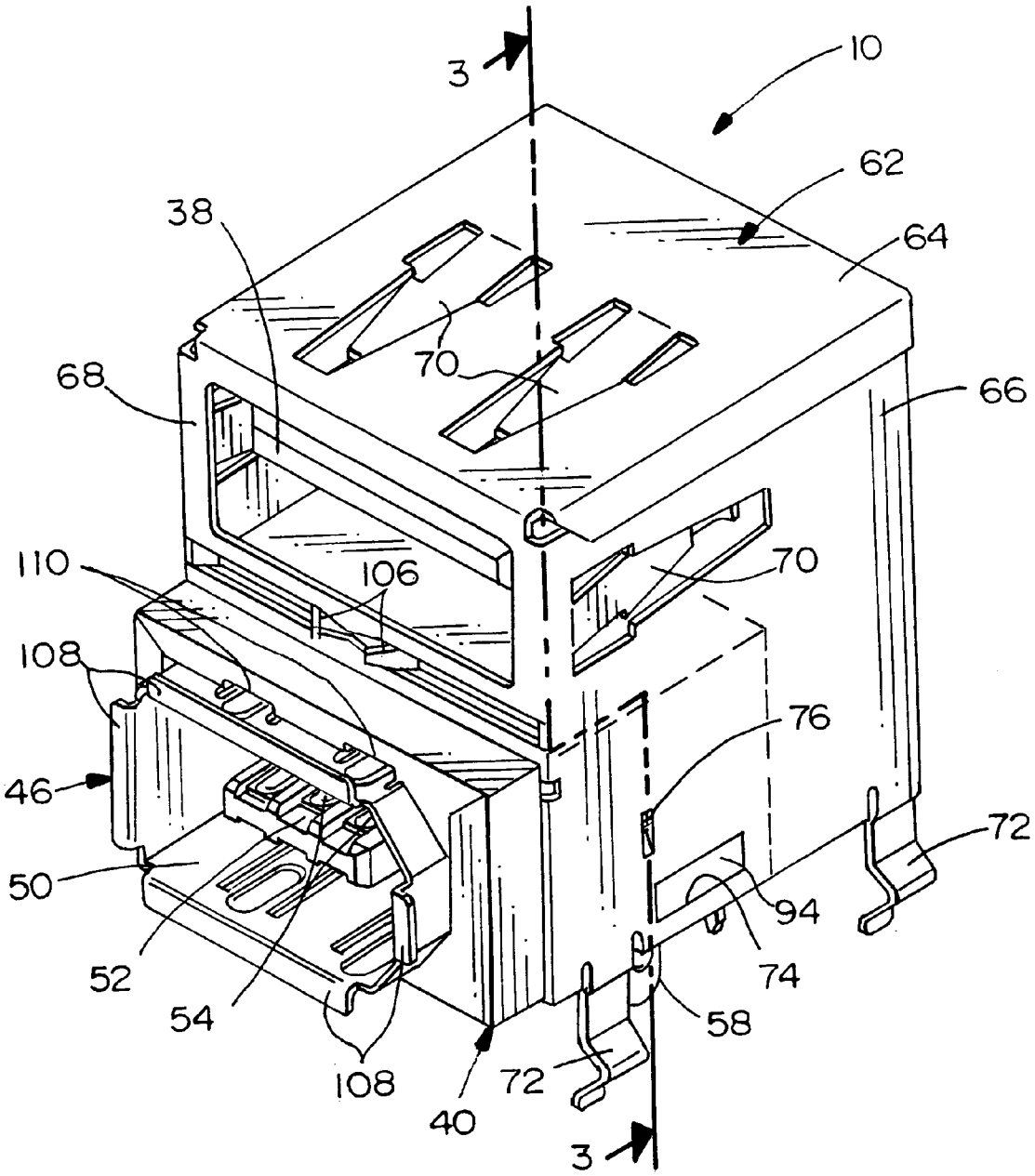
FIG. 9 is a perspective view of the entire assembled connector assembly.

Finally, FIG. 9 best shows how dielectric insert 40 and outer shell 50 of connector 46 project forwardly of front wall 68 of shielding shell 62 of connector assembly 10. The forwardly projecting portion of the dielectric insert will be disposed within aperture 18 (FIG. 1) of conductive panel 20 and, thereby, electrically isolate conductive shell 50 of connector 46 from the conductive panel and position the connection assembly 10 with respect to the panel 20. On the other hand, front wall 68 of conductive shielding shell 62 of the overall connector assembly will abut against and establish direct contact with the conductive panel. In fact, as seen in FIG. 9, a pair of spring fingers 106 are stamped and formed to project forwardly of front wall 68 of the shielding shell to establish a positive engagement with the conductive panel. When lower mating connector 14 is mated with connector 46, latch arms 34 (FIGS. 1 and 2) snappingly engage behind outwardly directed flanges 108 (FIG. 9) of shell 50 of connector 46. Additionally, recesses 110 in the insert 40 allow upward flexure of the spring fingers 56 on the top of the conductive shell 50 upon insertion of lower complementary mating connector 14 into the connector 46.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector assembly, comprising:

a dielectric housing defining first and second connector portions, the first connector portion mounting a plurality of electrical terminals each for engaging an appropriate terminal of a first complementary mating connector, the second connector portion defining a receptacle;

an electrical connector including an outer conductive shell mounted in said receptacle and having a plurality of electrical terminals each for engaging an appropriate terminal of a second complementary mating connector, said outer conductive shell surrounding said plurality of electrical terminals;

a conductive shielding shell about a substantial portion of the dielectric housing; and at least one electrical element captured by the dielectric housing and held in contact between the outer conductive shell of the electrical connector and the conductive shielding shell to establish a predetermined electrical coupling therebetween.

2. The electrical connector assembly of claim 1 wherein said electrical element is selected from a group consisting of a capacitor, an inductor, a resistor and a diode.

3. The electrical connector assembly of claim 1 wherein said conductive shell projects forwardly of the dielectric housing.

4. The electrical connector assembly of claim 1 wherein said outer conductive shell of the connector and the conductive shielding shell are stamped and formed of sheet metal material and include leg portions for mounting the assembly on the printed circuit board.

5. The electrical connector assembly of claim 1 wherein said second connector portion of the dielectric housing includes a pocket for receiving the electrical element.

6. The electrical connector assembly of claim 1 including a plurality of different electrical elements captured by the dielectric housing.

7. The electrical connector assembly of claim 1 wherein said conductive shielding shell includes a contact adapted for engaging an appropriate outer conductive shell of the first complementary mating connector.

8. The electrical connector assembly of claim 7 wherein said conductive shielding shell is stamped and formed of sheet metal material, and said contact comprises at least one cantilevered spring arm.

9. The electrical connector assembly of claim 1 wherein said second connector portion of the dielectric housing comprises a dielectric insert separate from the first connector portion of the dielectric housing.

10. The electrical connector assembly of claim 9 wherein said dielectric insert includes a pocket for receiving the electrical element.

11. The electrical connector assembly of claim 10 wherein said dielectric insert includes a movable wall for opening the pocket to allow for insertion of the electrical element thereinto and for closing the pocket to capture the electrical element therein.

12. The electrical connector assembly of claim 11 wherein said dielectric insert includes at least a pair of relatively movable side walls defining said receptacle and comprising said movable wall.

13. The electrical connector assembly of claim 12 wherein one of said pair of side walls includes the pocket for the electrical element, and the other side wall is adapted for opening and closing the pocket.

14. The electrical connector assembly of claim 13 wherein said dielectric insert, including said side walls, is molded of plastic material, and the side walls are joined for relative movement by an integrally molded hinge.

15. The electrical connector assembly of claim 1 wherein said outer conductive shell of the connector and the shielding shell are stamped and formed of sheet metal material and include spring fingers for engaging opposite electrodes of the electrical element.

16. The electrical connector assembly of claim 15 wherein a conductive compliant pad is interposed between the spring fingers and the electrodes.

17. An electrical connector assembly, comprising:

an electrical connector mounting a plurality of terminals and including an outer conductive shell surrounding said plurality of terminals;

a dielectric insert defining a receptacle for the electrical connector;

an outer shielding shell surrounding a substantial portion of the dielectric insert; and at least one electrical element captured by the dielectric insert and held in contact between the outer conductive shell of the connector and the outer shielding shell to establish a predetermined electrical coupling therebetween.

18. The electrical connector assembly of claim 17 wherein said outer conductive shell of the connector and the outer shielding shell are stamped and formed of sheet metal material and include spring fingers for engaging opposite electrodes of the electrical element.

19. The electrical connector assembly of claim 17 wherein said outer conductive shell of the connector and the outer shielding shell are stamped and formed of sheet metal material and include leg portions for mounting the assembly on the printed circuit board.

20. The electrical connector assembly of claim 17 wherein said electrical element is selected from the group consisting of: a capacitor, a resistor, an inductor and a diode.

21. The electrical connector assembly of claim 17 wherein said dielectric insert includes a pocket for receiving the electrical element.

22. The electrical connector assembly of claim 21 wherein said dielectric insert includes a movable wall for opening the pocket to allow for insertion of the electrical element thereinto and for closing the pocket to capture the electrical element therein.

23. The electrical connector assembly of claim 22 wherein said dielectric insert includes at least a pair of relatively movable side walls defining said receptacle and comprising said movable wall.

24. The electrical connector assembly of claim 23 wherein one of said side walls includes the pocket for the electrical element, and the other side wall is adapted for opening and closing the pocket.

25. The electrical connector assembly of claim 24 wherein said dielectric insert, including said side walls, is molded of plastic material, and the side walls are joined for relative movement by an integrally molded hinge.

26. An electrical connector assembly mounted on a support including at least one ground conductor, comprising:

a dielectric housing defining first and second connector portions, the first connector portion mounting a plurality of electrical terminals each for engaging an appropriate terminal of a first complementary connector, the second connector portion mounting a plurality of electrical connector terminals each for engaging an appropriate terminal of a second complementary connector;

a first conductive shell enclosing said plurality of terminals in the first connector portion, said first conductive shell being connected to one of the ground conductors on the support, and a second conductive shell enclosing said plurality of terminals in the second connector portion; and at least one electrical element held by the dielectric housing in contact between the second conductive shell and one of the ground conductors on the support.

27. The electrical connector assembly of claim 26 wherein said dielectric housing insulates said first conductive shell from said second conductive shell.

* * * * *